US005592046A

United States Patent [19]

Kim

[11] Patent Number: 5,592,046

[45] Date of Patent: Jan. 7, 1997

[54] ELECTRONIC GUN FOR COLOR CATHODE-RAY TUBE

[75] Inventor: Won H. Kim, Kyungsangbuk-do, Rep. of Korea

[73] Assignee: Goldstar Co., Ltd., Seoul, Rep. of Korea

[21] Appl. No.: 127,528

[22] Filed: Sep. 28, 1993

[30] Foreign Application Priority Data

| | | | |
|---|---|---|---|
| Sep. 30, 1992 | [KR] | Rep. of Korea | 17927/1992 |
| Oct. 29, 1992 | [KR] | Rep. of Korea | 20079/1992 |
| Aug. 2, 1993 | [KR] | Rep. of Korea | 14947/1993 |

[51] Int. Cl.[6] ..... H01J 29/50; H01J 29/46

[52] U.S. Cl. ..... 313/447; 313/412; 313/414; 313/446

[58] Field of Search ..... 313/412, 414, 313/446, 447

[56] References Cited

U.S. PATENT DOCUMENTS

| | | | |
|---|---|---|---|
| 5,038,073 | 8/1991 | Son | 313/414 |
| 5,113,112 | 5/1992 | Shimoma | 313/412 |
| 5,146,133 | 9/1992 | Shirai | 313/414 |

*Primary Examiner*—Sandra L. O'Shea
*Assistant Examiner*—John Ning

[57] ABSTRACT

An electron gun for a color cathode-ray tube reducing the spherical aberration and the flying spot aberration, thus improving the resolution of the color cathode-ray tube. The electron gun comprises a pair of accelerating/focusing electrodes coaxial with the tube and providing a passage for the electron beams. The electrodes are spaced apart from each other by a predetermined distance and has individual common openings, and each includes an envelop having a rim adjacent a corresponding common opening, the rim surrounding the plurality of electron beams and defining the common opening, and a control electrode plate being placed in the envelop and recessed from the rim by a predetermined distance in the axial direction in order for controlling the plurality of electron beams. Each electrode plate has a center opening and a pair of opposed outer openings. The center opening may be a rectangular opening or rounded at its upper and lower ends. The outer openings are disposed at opposed sides of the center opening and each opening toward an inner surface of the envelop. The open space of the outer opening may be gradually enlarged toward the inner surface of the envelop.

11 Claims, 5 Drawing Sheets

ELECTRONIC GUN FOR COLOR CATHODE-RAY TUBE

BACKGROUND OF THE INVENTION

1. Field of the Invention

The present invention relates to an electron gun for a color cathode-ray tube, and more particularly to a configuration of electrodes of an electron gun constituting the main electrostatic focusing lens of the electron gun.

2. Description of the Prior Art

A conventional color cathode-ray tube with an in-line type electron gun is shown in FIG. 1. A glass envelope 1 of the tube is composed of a front panel 2 and a funnel 3 connected to the panel 2. A fluorescent screen which is coated with three color phosphors for developing a color image is disposed on the inner wall of the panel 2. A shadow mask 4 for color selection is disposed inside the envelop 1 adjacent the panel 2 and spaced from the fluorescent screen.

An electron gun 5 is coaxially disposed inside the tubular neck portion 3*a* of the funnel 3 to generate and direct three electron beams, which represent the three primary colors respectively, along coplanar convergent paths through the shadow mask 4 to the fluorescent screen. More specifically, the electron beams, which are composed of thermions, are emitted from cathodes 6, 7 and 8 of electron gun 5, and pass through corresponding apertures in first and second grid electrodes 9 and 10. Then the electron beams are directed along the electron beam paths 11, 12 and 13 (shown at the solid lines of FIG. 1) to the front 2, respectively. At this time, each of the cathodes 6, 7 and 8 and its corresponding aperture formed in the first and second grid electrodes 9 and 10 have a common central axis parallel to the others on a common plane. The three central axes are coincident with the electron beam paths 11, 12 and 13, respectively.

Referring to FIG. 1, the line Z—Z extending along the central electron beam path 12, i.e., the center of the electron beam paths 11, 12 and 13, to the panel 2 is called the "axial direction", hereinafter. Similarly, the line X—X, which is perpendicular to the axial direction and extending across the common plane including the electron beam paths 11, 12 and 13, is called the "horizontal direction". The line Y—Y (not shown), which is perpendicular to the axial and horizontal directions, is called the "vertical direction."

Thereafter, the three electron beams travel through the first and second grid electrodes 9 and 10 along the electron beam paths 11, 12 and 13 arranged on the common plane and then travel through third and fourth grid electrodes 14 and 15. Here, the third and fourth grid electrodes 14 and 15 constitute an auxiliary focusing lens or a pre-focus lens. Then, the electron beams travel through a focus electrode 16 (hereinbelow, referred to as "the first accelerating/focusing electrode") as well as an anode electrode 17 (hereinbelow, referred to as "the second accelerating/focusing electrode"), both electrodes 16 and 17 constituting the main focusing lens of the electron gun 5.

To constitute the main focusing lens, a potential of 25 KV–35 KV is applied to the second accelerating/focusing electrode 17, and a potential of about 20%–30% of that applied to the second electrode 17 is applied to the first electrode 16.

Since the center portion of the main focusing lens, which is formed by the potential difference between the first and second accelerating/focusing electrodes 16 and 17, is coaxial with the central electron beam path 12, the central beam, i.e., one center beam of the three electron beams, which travels through the center portion of the main focusing lens is focused to be thin and accelerated to travel straight along the axial direction to the fluorescent screen.

However, since the outer portions of the main focusing lens are not coaxial with the central electron beam path 12, two outer beams of the three electron beams which travel through the outer portions of the main focusing lens are not only focused to be thin, but also subjected to a converging effect toward the central electron beam.

Hence, the three electron beams are converged onto the shadow mask 4 in an overlapping fashion and then accelerated to reach the fluorescent screen, thus to form a spot on the screen.

To scan electron beams on the fluorescent screen, an external magnetic deflection yoke 18 is externally provided adjacent glass envelope 1. The above operation for thinning electron beams by the main focusing lens is called "focusing" and the above operation for converging electron beams by the main focusing lens is called "static convergence (hereinbelow, referred to simply as "the STC")".

FIG. 2 illustrates a partially cutaway perspective view of the first and second accelerating/focusing electrodes 16 and 17 constituting the main focusing lens of the prior art electron gun of FIG. 1. The first accelerating/focusing electrode 16 is composed of a non-cylindrical electrode tube with one end open and another end partially closed.

The first electrode 16 includes an envelope 19 from which a closed end face 20 extends. The closed end face 20 includes three separate beam passage apertures 41, 42, and 43 which are axially parallel to one another. These beam passage apertures 41, 42 and 43 are surrounded by cylindrical lips 51, 52 and 53, respectively. Each cylindrical lip is projected from the closed end face 20 inwardly toward the open end of the envelope 19.

Second accelerating/focusing electrode 17 has substantially the same configuration as the first electrode 16 and is symmetrical to the first electrode 16 with respect to the horizontal direction. This second accelerating/focusing electrode 17 includes an envelope 21 and a closed end face 22 integrally formed with the envelope 21. The closed end face 22 includes three electron beam passage apertures 61, 62, and 63. These beam passage apertures 61, 62 and 63 are surrounded by individual cylindrical lips 71, 72 and 73. Each cylindrical lip is projected from closed end face 22 inwardly toward the open end of envelope The outer beam passage apertures 41 and 43 of the first accelerating/focusing electrode 16 are spaced apart from the central beam passage aperture 42 at an equal first distance, i.e., the center to center distance, along the horizontal direction and this distance is equal to the distance between each of the outer electron beam paths 11 and 13 and the central electron beam path 12 of FIG. 1. Likewise, the outer beam passage apertures 61 and 63 of the second accelerating/focusing electrode 17 are spaced apart from the central beam passage aperture 62 at an equal second distance. The second distance is slightly greater than the above first distance.

These first and second accelerating/focusing electrodes 16 and 17 are arranged such that their closed end faces 20 and 22 face each ether and are spaced out at a given distance "g".

In accordance with this prior art configuration, the three separate main focusing lenses are provided for the three electron beams, respectively.

Otherwise stated, three pairs of electron beam passage apertures, a first pair consisting of the outer apertures 41 and 61, a second pair of the central apertures 42 and 62 and a third pair of the outer apertures 43 and 63, are provided in first and second accelerating/focusing electrodes 16 and 17. The above three pairs of electron beam passage apertures are surrounded by three pairs of lips, that is, a first pair consisting of lips 51 and 71, a second pair of lips 52 and 72, and a third pair of lips 53 and 73, respectively. Here, the three pairs of electron beam passage apertures 41 and 61, 42 and 62, and 43 and 63 constitute the three separate main focusing lenses, respectively, each of the three focusing lenses focusing a respective one of the three electron beams.

As described above, the second distance between the beam passage apertures 61, 62 and 63 of the second accelerating/focusing electrode 17 is greater than the first distance between the beam passage apertures 41, 42, and 43 of the first accelerating/focusing electrode 16. Thus, the central main focusing lens, which includes the central beam passage apertures 42 and 62, is coaxial with respect to the axial direction, while the other main focusing lenses or the outer main focusing lenses, one including the outer beam passage apertures 41 and 61 and the other a pair of the outer beam passage apertures 43 and 63, are not coaxial with respect to the axial direction.

Accordingly, the central electron beam passing through the central main focusing lens is focused to be thin and accelerated to travel straight along the axial direction to the fluorescent screen, while the outer electron beams passing through the outer main focusing lenses are not only focused to be thin, but also subjected to a converging effect toward the central electron beam.

However, as apparent to those skilled in the art, the known electron gun is apt to be affected adversely by spherical aberration of its main focusing lenses since its main focusing lenses have small apertures of about 5.5–5.9 mm. In this regard, there occurs a haze phenomenon in that the peripheral light of an electron beam spot is not clear, and this deteriorates the resolution of a color cathode-ray tube.

This haze phenomenon is noted to be mainly affected by the aperture R of the main focusing lens.

That is, the spherical aberration of the main focusing lens is in inverse proportion to $R^3$ or the third power of the aperture R of the main focusing lens, and this aperture R is substantially proportional to a diameter D of corresponding electron beam passage apertures of the first and second accelerating/focusing electrodes 16 and 17.

It is thus preferred to enlarge the diameter D of the electron beam passage apertures of the first and second accelerating/focusing electrodes 16 and 17 in order to reduce the bad effect given by the spherical aberration of the main focusing lenses.

However, such an enlargement of the diameter D is also accompanied with deterioration of lens action of the main focusing lens, and thus results in a flying spot aberration in that the focusing voltages for the electron beam spots do not precisely agree with each other.

If described in detail, the Z-axial potential function $\phi''(Z)$ and the spherical aberration component C are represented by the following relations (I) and (II), respectively.

$$\phi''(Z) \propto 2/g \times (V_2 - V_1) \times 1/R \quad \text{(I)}$$

$$C \propto M/(16 \times R^3) \quad \text{(II)}$$

wherein $V_1$: voltage of the first accelerating/focusing electrode 16, $V_2$: voltage of the second accelerating/focusing electrode 17, g: distance between the first and second accelerating/focusing electrodes 16 and 17, M: magnification of the main focusing lens, and R: aperture of the main focusing lens.

In accordance, with the above when the aperture of the main focusing lens is enlarged by δR, the lens action of this main focusing lens is reduced by about 1/δR and, C (the spherical aberration component)≈$1/(\delta R)^3$.

When the aperture R of the main focusing lens is enlarged in order to remove the problem caused by the flying spot aberration as described, the size Ds of the electron beam spot on the screen is represented by the following relation (III).

$$Ds = \sqrt{(Dx + Dsa)^2 + Dsc^2} \quad \text{(III)}$$

wherein

Dx: enlargement component of a cross-over point dx by the magnification M of the main focusing lens, otherwise stated, Dx∝(Midx,)Mxdx, Dsc: enlargement component of the electron beam by a space charge effect, that is, Dsc=f(rsc/ri)∝($i^{1/2}$/V¾)(Z/ri) wherein i is a flying beam, V is a high voltage, and rsc/ri is the beam spread, and Dsa: enlargement component of the electron beam by the spherical aberration component.

However, since the three electron beam passage apertures of the in-line type color cathode-ray tube are arranged on a common plane as described above, the beam passage apertures 41, 42 and 43 of the first accelerating/focusing electrode 16 and the beam passage apertures 61, 62 and 63 of the second accelerating/focusing electrode 17 are limited in their diameters to be not more than ⅓ of an inner diameter of the neck portion 3*a* of the cathode-ray tube.

As described in detail in conjunction with FIG. 3, the inner diameter L of the neck portion 3*a* of the cathode-ray tube is represented by the following relation (IV).

$$D+2(S+G+1) \leqq L \quad \text{(IV)}$$

wherein

D: diameter of each of the beam passage apertures of the first and second accelerating/focusing electrodes 16 and 17, S: beam separation, G: minimum gap between the first and second accelerating/focusing electrodes 16 and 17 and the inner surface of the neck portion 3*a*, the gap allowing electric insulation to be achieved between the electrodes 16 and 17 and the inner surface of the portion 3*a*, and $l_1$ and $l_2$: bridge widths between the beam passage apertures of the first and second accelerating/focusing electrodes 16 and 17, the widths being minimum widths allowing the electrodes to be mechanically prepared.

At this time, each of $l_1$ and $l_2$ should be longer than 1.0 mm from the viewpoint of the conventional designing condition of the electrodes 16 and 17, and thus this results in D≧Z S−1 (mm).

In addition, the gap G between the envelopes 19 and 21 of the first and second accelerating/focusing electrodes 16 and 17 and the inner surface of the neck portion 3*a* should be longer than 1.0 mm such that electric insulation is achieved between the electrodes 16 and 17 and the inner surface of the neck portion 3*a*, and this results in D≦(L/3)−2 (mm).

Accordingly, the diameter D of each of the beam passage apertures of the first and second accelerating/focusing electrodes 16 and 17 is inevitably limited to be not more than ⅓ of the inner diameter L of the neck portion 3*a* of the cathode-ray tube.

However, in the prior art electron gun, the enlargement of the diameter D of the electron beam passage apertures of the first and second accelerating/focusing electrodes 16 and 17 is achieved only by enlarging either the beam separation S or the inner diameter L of the neck portion 3*a*.

Thus, the prior art electron gun has a problem in that it increases electric power consumption for the external magnetic deflection yoke 18, and deteriorates the beam converging effect toward the central electron beam due to the enlargement of the beam separation.

SUMMARY OF THE INVENTION

It is, therefore, an object of the present invention to provide an electron gun for a color cathode-ray tube in which the aforementioned problem introduced by the prior art electron gun can be overcome and which practically efficiently enlarges apertures of main focusing lenses of electrodes placed in a neck portion of the electron gun, thus to improve the beam converging effect toward the central electron beam and to improve the resolution of the color cathode-ray tube.

In accordance with an embodiment of the present invention, the electron gun comprises means for generating a plurality of electron beams, the beams representing color components for forming a color image, respectively; a pair of accelerating/focusing electrodes substantially symmetrical to one another with respect to the horizontal direction and coaxial with the tube in the axial direction so as to provide a passage for the plurality of electron beams, the pair of electrodes being spaced apart from each other by a predetermined distance in the axial direction and having individual common openings, the common openings facing each other. Each of the electrodes includes an envelop having a rim adjacent a corresponding common opening, the rim surrounding the plurality of electron beams and defining the common opening; a control electrode plate placed in the envelop and recessed from the rim by a predetermined distance in the axial direction in order to control the plurality of electron beams, the control electrode plate having a rectangular center opening and a pair of rectangular opposed outer openings with the outer openings thereof being disposed at opposed sides of the center opening and each opening toward an inner surface of the envelop.

In accordance with an embodiment of the present invention, the electron gun comprises means for generating a plurality of electron beams, the beams representing color components for forming a color image, respectively; a pair of accelerating/focusing electrodes arranged substantially symmetrical to one another with respect to the horizontal direction and coaxial with the tube in the axial direction so as to provide a passage for the plurality of electron beams, the pair of accelerating focusing electrodes being spaced apart from each other by a predetermined distance in the axial direction and having individual common openings. The common openings face each other, each of the electrodes include: an envelop having a rim adjacent a corresponding common opening, the rim surrounding the plurality of electron beams and defining the common opening; and a control electrode plate being placed in the envelop and recessed from the rim by a predetermined distance in the axial direction in order for controlling the plurality of electron beams, the electrode plate having a center opening and a pair of opposed outer openings, the center opening having rounded upper and lower ends, the outer openings being disposed at opposed sides of the center opening and each opening toward an inner surface of the envelop, and an open space of each of the outer openings being gradually enlarged toward the inner surface of the envelop.

BRIEF DESCRIPTION OF THE DRAWINGS

The above and other objects, features and other advantages of the present invention will be more clearly understood from the following detailed description taken in conjunction with the accompanying drawings, in which:

FIG. 8*b* is a half sectional view of the second accelerating/focusing electrode taken along the section line D—D of FIG. 8*a.

DESCRIPTION OF THE PREFERRED EMBODIMENTS

Figure 1:
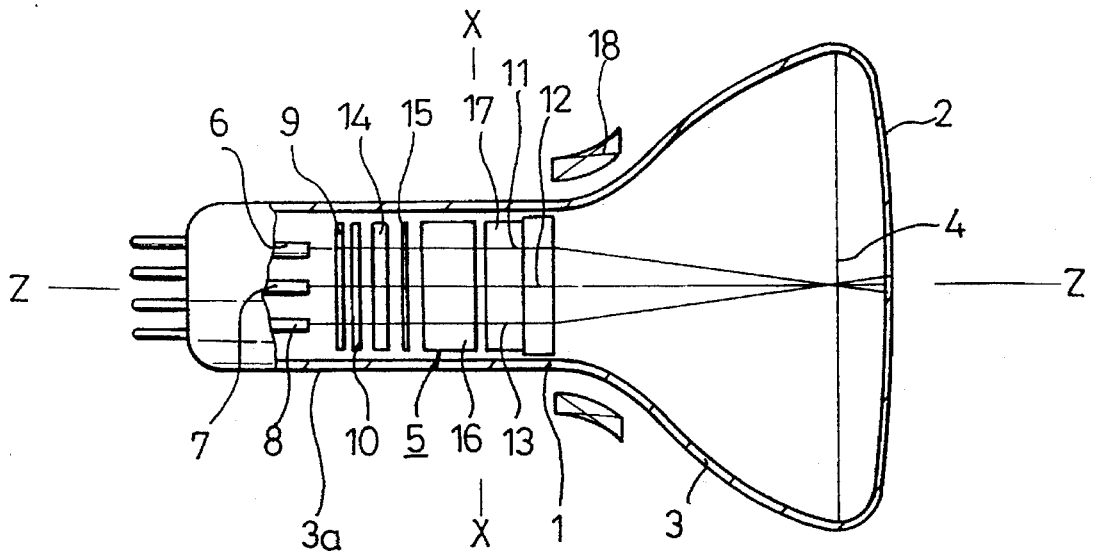
FIG.1 prior art
FIG. 1 is a horizontal cross sectional view of a prior art color cathode-ray tube.
Figure 2:
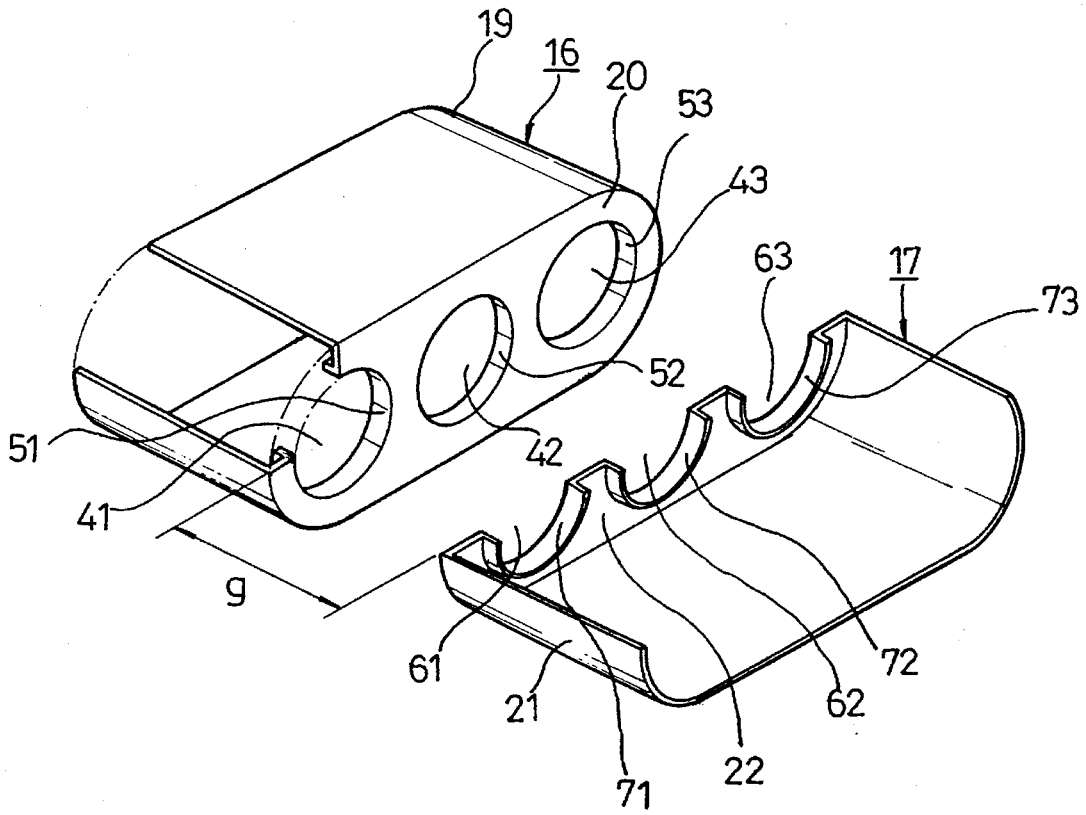
FIG.2 prior art
FIG. 2 is a perspective view of a partially cutaway portion of a main focusing lens of an electron gun of the prior art color cathode-ray tube of FIG. 1.
Figure 3:
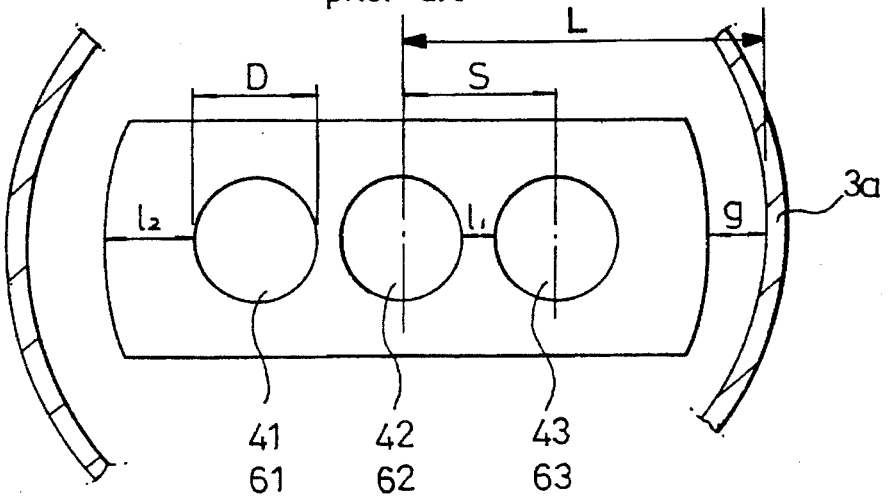
FIG.3 prior art
FIG. 3 is a schematic sectional view of the main focusing lens of the electron gun of the prior art color cathode-ray tube, when positioned in a neck portion of the cathode-ray tube.
Figure 4:
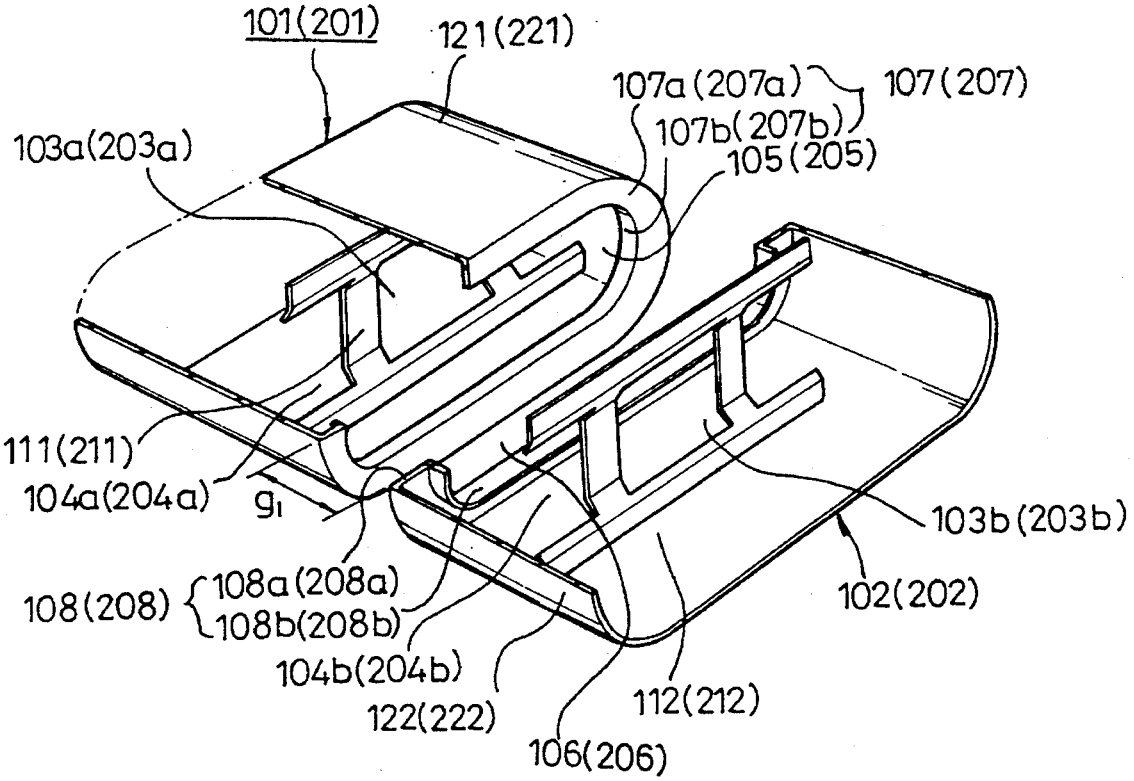
FIG. 4 is a perspective view of a partially cutaway portion of a main focusing lens of an electron gun in accordance with the present invention, commonly showing a primary embodiment and a second alternate embodiment of the present invention.

With reference to FIG. 4, there is shown in a partially sectional perspective view of a main focusing lens of an electron gun of a color cathode-ray tube in accordance with the present invention. In this drawing, a primary embodiment and a second alternate embodiment of the present invention are commonly shown. Those elements common to both the primary embodiment and the second alternate embodiment carry reference numerals which differ by 100 (e.g., 101 verses 201) with the reference numerals of the second alternate embodiment being parenthesized.

Primary Embodiment

In the electron gun in accordance with the primary embodiment of the present invention, a first accelerating/focusing electrode 101 and a second accelerating/focusing electrode 102, facing each other and spaced apart from each other by a predetermined distance $g_1$, constitute a main focusing lens of the electron gun.

The first and second electrodes 101 and 102 comprise non-cylindrical electrode tubes including individual envelopes 121 and 122, respectively. The envelopes 121 and 122 of the first and second electrodes 101 and 102 include individual common openings 105 and 106 at their facing ends.

Here, it is preferred to form each of the common openings 105 and 106 such that each has an elliptical profile in which the vertical dimension thereof is less than the horizontal dimension thereof. The common openings 105 and 106 provide electron beam passages and are defined by elliptical rims 107 and 108 which extend integrally vertically from the envelops 121 and 122 at the facing ends and in turn project backward to define the common openings 105 and 106, respectively. Since the first accelerating/focusing electrode 101 and the second accelerating/focusing electrode 102 face each other as described above, the common openings 105 and 106 face each other.

Each of the elliptical rims 107 and 108 comprises an elliptical rim surface 107*a* or 108*a*, vertically extending from a corresponding envelop 121 or 122, and an elliptical track 107*b* or 108*b* projecting backward from the inner periphery of a corresponding rim surface 107*a* or 108*a* to define a corresponding common opening 105 or 106.

The first accelerating/focusing electrode 101 further includes a first control electrode plate 111 which is vertically placed inside the envelop 121 and recessed from a corresponding rim surface 107*a* by a predetermined distance in the axial direction, along which direction the electron beam travels.

In the same manner, the second accelerating/focusing electrode 102 includes a second control electrode plate 112 which is vertically placed inside the envelop 122 and recessed from a corresponding rim surface 108*a* by a predetermined distance in the axial direction.

Such an arrangement of the electrode plates 111 and 112 (namely, in that these plates 111 and 112 are recessed from the rim surfaces 107*a* and 108*a* by the predetermined distances in the axial direction, respectively) is to cause an electric field to infiltrate into deep portions behind the plates 111 and 112 during electron beam scanning, to thus effectively enlarge the aperture of the main focusing lens.

That is, such an arrangement effectively achieves a desired enlargement of the aperture of the main focusing lens without any actual physical enlargement of the outer appearance of the main focusing lens.

When the aperture of the main focusing lens is effectively as described above, the magnification of the main focusing lens is increased and this reduces the spherical aberration of the lens. Hence, the focusing characteristics of the main focusing lens is remarkably improved.

Figure 5A:
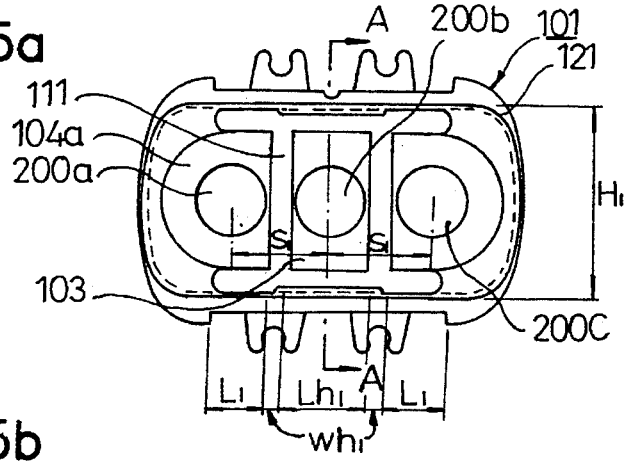
FIG. 5*a* is a front view of a first accelerating/focusing electrode of the electron gun in accordance with the primary embodiment of the present invention.
Figure 5B:
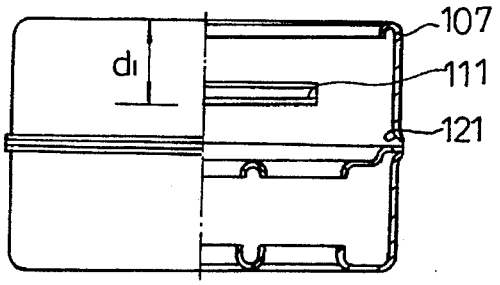
FIG. 5*b* is a half sectional view of the first accelerating/focusing electrode taken along the section line A—A of FIG. 5*a;*
Figure 5C:
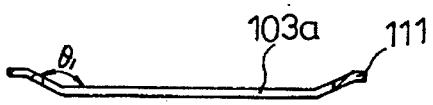
FIG. 5*c* is a sectional view of a first control electrode plate in accordance with the primary embodiment of the present invention.

Turning to FIGS. 5*a* to 5*c*, the first control electrode plate 111 is a plate member which has a predetermined thickness. This electrode plate 111 has upper and lower beams, between which a pair of spaced columns integrally extend at a right angle to the beams, thus to define a rectangular center opening 103*a* inside the beams and the columns, and to define a pair of opposed outer openings 104*a* at opposed sides of the center opening 103*a*. The opposed outer openings 104*a* open at their outside and are symmetrical with respect to the center opening 103*a*.

Here, the first electrode plate 111 is arranged in the envelop 121 of the first accelerating/focusing electrode 101 such that the longer sides of the rectangular center opening 103*a* vertically crosses the horizontal axis of the common opening 105 of the first electrode 101. In addition, each of these longer sides is formed by the columns S (shown in FIG. 5*a*). As shown in FIG. 5*c* for the first electrode plate 111 and in FIG. 6*b* for the second electrode plate 112, each of these columns has its ends inclined at an angle $\theta_1$ for the first electrode plate and $\theta_2$ for the second electrode plate near its connection points to the upper and lower beams such that a center portion of the left and right sides of the center opening (illustrated in FIG. 5*a* for the first electrode plate and in FIG. 6*b* for the second electrode plate) is located at a different axial position from the axial position at the top and bottom of the center opening.

When the opposed ends of the columns of the first control electrode plate 111 are inclined at the inclination angles $\Theta_1$, respectively, as described above, the lens action of the main focusing lens in the horizontal direction is strengthened and, as a result, the lens actions of the main focusing lenses in the horizontal and in the vertical directions are desirably balanced.

However, it should be noted that the first control electrode plate 111 of the present invention may comprise a plane plate having columns without bends near their end.

Figure 6A:
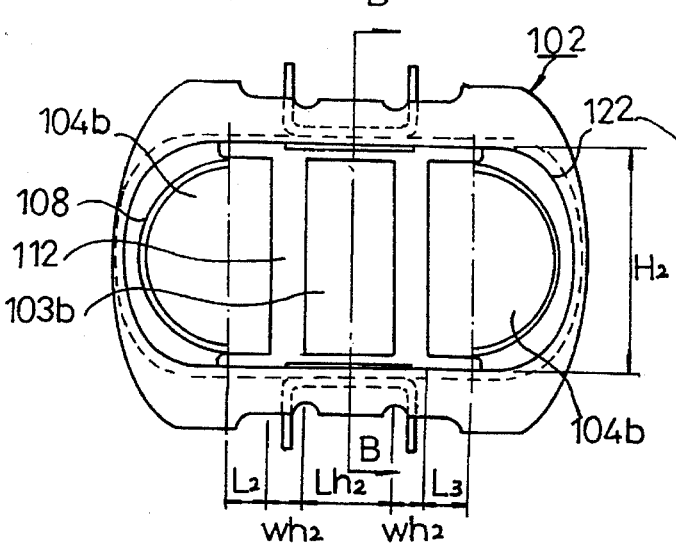
FIG. 6*a* is a front view of a second accelerating/focusing electrode of the electron gun in accordance with the primary embodiment of the present invention.
Figure 6B:
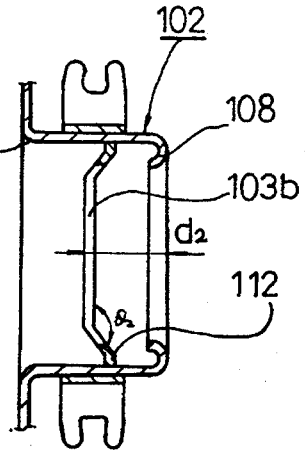
FIG. 6*b* is a half sectional view of the second accelerating/focusing electrode taken along the section line B—B of FIG. 6*a;*

Similarly, the second control electrode plate 112 is a plate member which has a predetermined thickness, This electrode plate 112 has upper and lower beams, between which a pair of spaced columns integrally vertically extend, thus to define a rectangular center opening 103*b* inside the beams and the columns and to define a pair of opposed outer openings 104*b* at opposed sides of the center opening 103*b* as shown in FIGS. 6*a* and 6*b*. The opposed outer openings 104*b* open at their outside and are symmetrical with respect to the center opening 103*b*.

This second electrode plate 112 is arranged in the envelop 122 of the first accelerating/focusing electrode 102 such that the longer side of the rectangular center opening 103*b* vertically crosses with the horizontal axis of the common opening 106 of the second electrode 102. Each of the columns defining the longer of the sides of the rectangular center opening of the second control electrode plate 112 is preferably inclined at an inclination angle $\Theta_2$ as shown in FIG. 6*b*.

The central electron beam path of the electron gun is thus surrounded by the rectangular center opening 103*a* of the first control electrode plate 111 as well as by the rectangular center opening 103*b* of the second control electrode plate 112. The side electron beam paths of the electron gun are surrounded by the outer openings 104*a* and 104*b* of the first and second control electrode plates 111 and 112 and the inner surfaces of the envelops 121 and 122 of the first and second accelerating/focusing electrodes 101 and 102.

That is, the side electron beam paths are defined by the outer openings 104*a* and 104*b* of the first and second control electrode plates 111 and 112 and the envelops 121 and 122 of the first and second accelerating/focusing electrodes 101 and 102, so that the apertures of the main focusing lenses for the side electron beams are effectively enlarged.

When the apertures of the main focusing lenses for the side electron beams are effectively enlarged as described above, the spherical aberration as well as the flying spot aberration is desirably reduced, thus achieving a desired formation of the beam spot on the fluorescent screen.

The measurements of elements of the electron gun in accordance with the primary embodiment of the present invention are given in the Table 1.

TABLE 1

The First Accelerating/Focusing Electrode 101

Recessed distance $d_1$ of the first control electrode plate 111 from the rim 107—3.5 mm, Beam separation $S_1$ between the electron beam passage apertures 100*a*, 100*b* and 100*c*—5.5 mm, Horizontal width $Lh_1$ of the rectangular center opening 103*a* of the first plate 111—4.5 mm, Horizontal width $Wh_1$ of a bridge of the first plate 111—0.5 mm, Horizontal length $L_1$ of each of the outer openings 104*a* of the first plate 111—2.75 mm, Total height $H_1$ of the first plate 111—8.0 mm, Vertical width $Wv_1$ of the bridge of the first plate 111—1.5 mm, and Inclination angle $\Theta_1$ of the inclined opposed ends of the first plate 111—25°–35°.

The Second Accelerating/Focusing Electrode 102

Recessed distance $d_2$ of the second control electrode plate 112 from the rim 108—2.45–2.55 mm, Horizontal width $Lh_2$ of the rectangular center opening 103*b* of the second plate 112—2.7 mm, Horizontal width $Wh_2$ of a bridge of the second plate 112—0.5 mm, Horizontal length $L_3$ of each of the outer openings 104*b* of the second plate 112—2.3 mm, Total height $H_2$ of the second plate 112—8.0 mm, Vertical width $Wv_2$ of the bridge of the second plate 112—1.5 mm, Inclination angle $\Theta_2$ of the inclined opposed ends of the second plate 112—25°–35°, and Gap $g_1$ between the rims 107 and 108 of the first and second accelerating/focusing electrodes 101 and 102—1.0 mm.

Second Alternate Embodiment

Figure 7A:
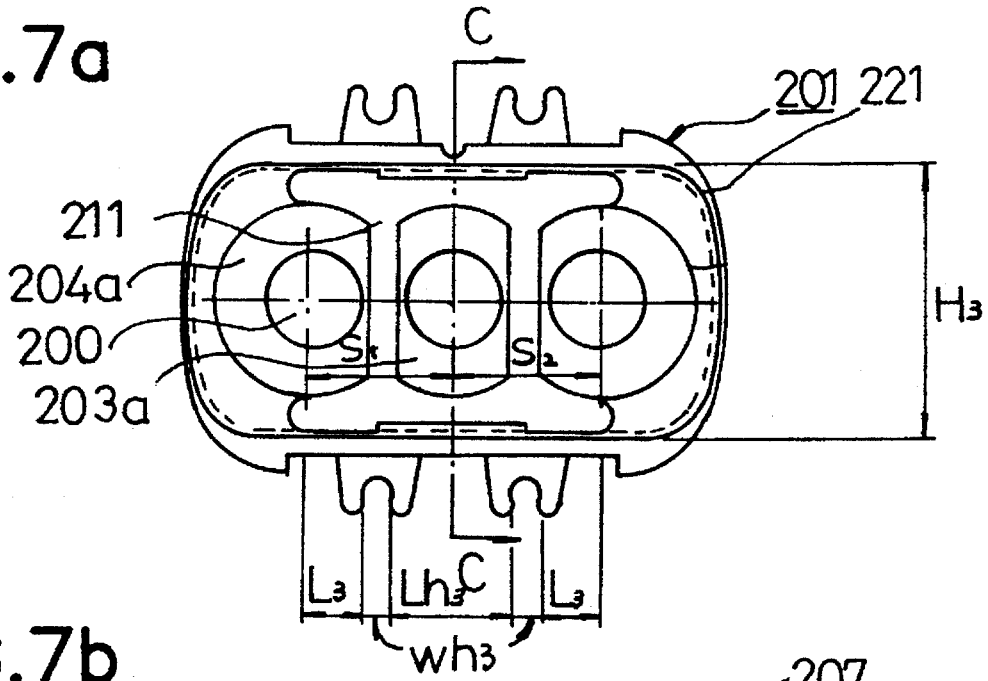
FIG. 7*a* is a front view of a first accelerating/focusing electrode of the electron gun in accordance with the second alternate embodiment of the present invention.
Figure 7B:
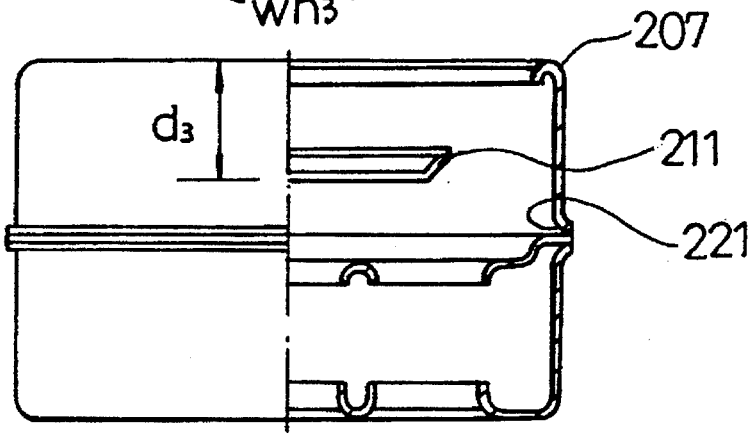
FIG. 7*b* is a half sectional view of the first accelerating/focusing electrode taken along the section line C—C of FIG. 7*a;*
Figure 7C:
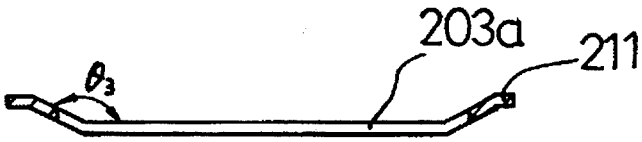
FIG. 7*c* is a sectional view of a control electrode plate in accordance with the second alternate embodiment of the present invention.
Figure 8A:
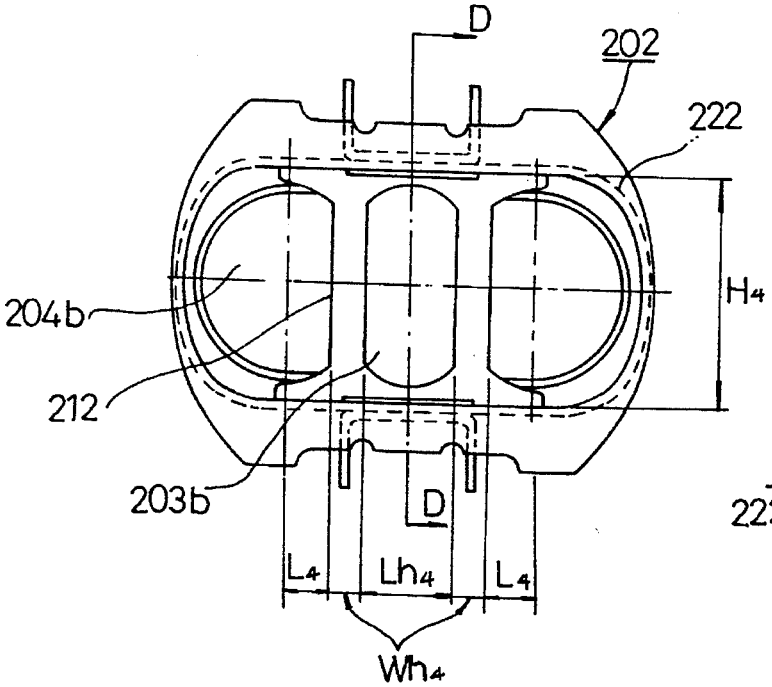
FIG. 8*a* is a front view of a second accelerating/focusing electrode of the electron gun in accordance with the second alternate embodiment of the present invention.
Figure 8B:
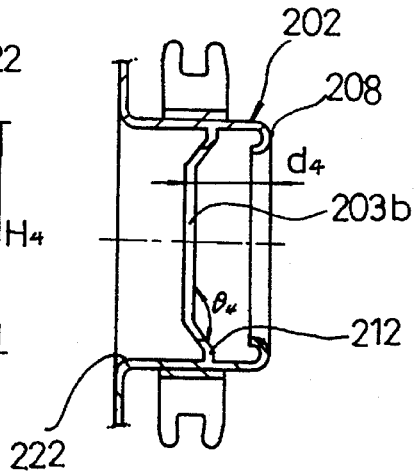

FIGS. 7*a* and 7*b* show a first accelerating/focusing electrode of the electron gun in accordance with the second alternate embodiment of the present invention, and FIG. 7*c* shows a first control electrode plate according to the second alternate embodiment of the present invention. FIGS. 8*a* and 8*b* show a second accelerating/focusing electrode according to the second alternate embodiment of the present invention.

In this second alternate embodiment, most of the elements are common with those of the primary embodiment, but the control electrode plates are altered, The elements of this second alternate embodiment are specified by "200" series numerals.

The first accelerating/focusing electrode 201 and a second accelerating/focusing electrode 202, facing each other and constituting the main focusing lenses of the electron gun, comprise non-cylindrical electrode tubes including individual envelopes 221 and 222, respectively. The envelopes 221 and 222 of the first and second electrodes 201 and 202 include individual elliptical common openings 105 and 106 at their facing ends.

The common openings 205 and 206 provide electron beam passages and are defined by elliptical rims 207 and 208 which integrally and vertically extend from the envelops 221 and 222 at the facing ends and in turn project backward to define the common openings 205 and 206, respectively. Each of the elliptical rims 207 and 208 comprises an elliptical rim surface 207*a* or 208*a*, vertically extending from a corresponding envelop 221 or 222, and an elliptical track 207*b* or 208*b* projecting backward from the inner periphery of a corresponding rim surface 207*a* or 208*a* to define a corresponding common opening 205 or 206.

The first accelerating/focusing electrode 201 further includes a first control electrode plate 211 which is vertically placed inside the envelop 121 and recessed from a corresponding rim surface 107*a* by a predetermined distance in the axial direction, As shown in FIGS. 7*a* to 7*c*, the first control electrode plate 211 comprises a plate member which has a predetermined thickness. This first electrode plate 211 has a center opening 203*a* and a pair of opposed outer openings 204*a* at opposed sides of the center opening 203*a*. The opposed outer openings 204*a* open at their outside and are symmetrical with respect to the center opening 203*a*.

Different from the primary embodiment, the columns defining the center opening 203*a* of this second alternate embodiment are rounded at their upper top and at their bottom, so that the center opening 203 shows rounded profiles at its upper and lower ends, respectively. On the other hand, the open space of each of the outer openings 204*a* is gradually enlarged toward the envelop 221. The enlargement of the open space of the outer opening 204*a* may be achieved by inclining or rounding the upper and lower ends of the outer opening 204*a*. The first electrode plate 211 is arranged in the envelop 221 such that the longer side of the center opening 203*a* vertically crosses the horizontal axis of the common opening 205 of the first electrode 201.

Each of the opposed ends of the columns of the first control electrode plate 211 is preferably inclined at an inclination angle $\Theta_3$ as shown in FIG. 7*c*. Such an inclination of the opposed ends of the plate 211 achieves the same result as that described for the primary embodiment.

Similarly, the second accelerating/focusing electrode 202 includes a second control electrode plate 212. As shown in FIGS. 8*a* and 8*b*, the second control electrode plate 212, comprising a plate member having a predetermined thickness, has a center opening 203*b* and a pair of opposed outer openings 204*b* at opposed sides of the center opening 203*b*. The opposed outer openings 204*b* open at their outside and are symmetrized with respect to the center opening 203*b*. In the same manner as the first electrode plate 211, this center opening 203*b* as well as the outer openings 204*b* is rounded at its upper and lower ends.

The second electrode plate 212 is arranged in the envelop 222 such that the longer side of the center opening 203*b* vertically crosses with the horizontal axis of the common opening 206 of the first electrode 202.

Each of the opposed side ends of the second control electrode plate 212 is preferably inclined at an inclination angle $\Theta_4$ as shown in FIG. 8*b*.

The central electron beam path of the electron gun is thus surrounded by the center opening 203*a* of the first control electrode plate 211 as well as by the center opening 203*b* of the second control electrode plate 212. The side electron beam paths of the electron gun are surrounded by the outer openings 204*a* and 204*b* of the first and second control electrode plates 211 and 212 and the inner surfaces of the envelops 221 and 222 of the first and second accelerating/focusing electrodes 201 and 202.

That is, the side electron beam paths are defined by the outer openings 204*a* and 204*b* of the first and second control electrode plates 211 and 212 and the envelops 221 and 222 of the first and second accelerating/focusing electrodes 201 and 202 so that the apertures of the main focusing lenses for the side electron beams are effectively enlarged.

The measurements of elements of the electron gun in accordance with the second alternate embodiment of the present invention are given in the Table 2.

TABLE 2

The First Accelerating/Focusing Electrode 201

Recessed distance $d_3$ of the first control electrode plate from the rim 207—3.50 mm, Beam separation $S_2$ between the electron beam passage apertures 200*a*, 200*b* and 200*c*—5.5 mm, Horizontal width $Lh_3$ of the center opening 203*a* of the first plate 211—4.5 mm, Horizontal width $Wh_3$ of a bridge of the first plate 211—0.5 mm, Horizontal length $L_3$ of each of the outer openings 204*a* of the first plate 211—2.45–2.55 mm, Total height $H_3$ of the first plate 211—8.0 mm, and Inclination angle $\Theta_3$ of the inclined opposed ends of the first plate 211—25°–35°.

The Second Accelerating/Focusing electrode 202

Recessed distance $d_4$ of the second control electrode plate 212 from the rim 208—2.45 mm, Horizontal width $Lh_4$ of the center opening 203*b* of the second plate 212—2.70 mm, Horizontal width $Wh_4$ of a bridge of the second plate 212—0.50 mm, Horizontal length $L_4$ of each of the outer openings 204*b* of the second plate 212—2.30 mm, Total height $H_4$ of the second plate 212—8.0 mm, and Inclination angle $\Theta_4$ of the inclined opposed ends of the second plate 212—25°–35°.

Operational Effect

Figure 9:
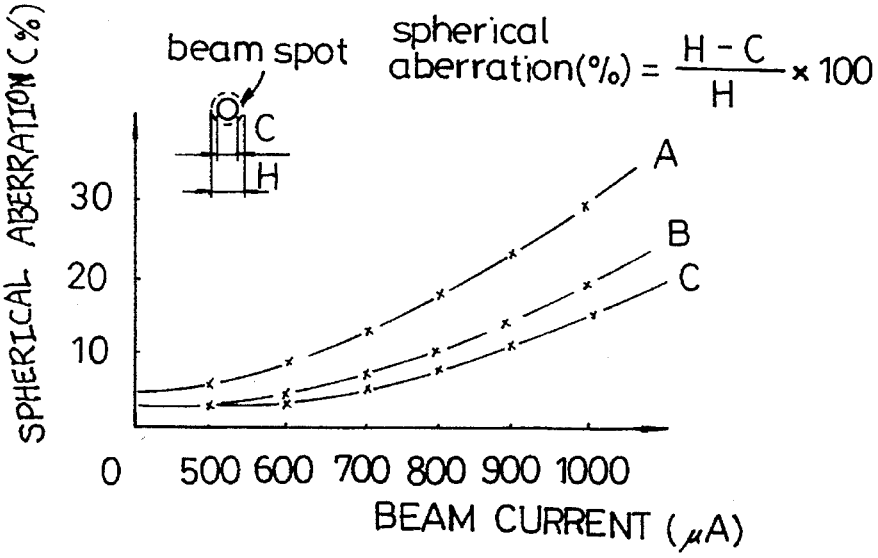
* and FIG. 9 is a graph representing the relation between a beam electric current and a spherical aberration of an electron gun of the present invention in comparison with that of the prior art electron gun.

FIG. 9 is a graph representing the relation between a beam electric current and spherical aberration of an electron gun beam of the present invention in comparison with that of the prior art electron gun beam. In this graph, the curve A represents the prior art, the curve B represents the primary embodiment of this invention and the curve C represents the second alternate embodiment of this invention.

From the graph of FIG. 9, it is noted that the bad effect given to each of the electron gun beams of the primary and second alternate embodiments of this invention by the spherical aberration % is relatively lower than that of the prior art and, furthermore, the difference of the effect between the present invention and the prior art is increased in proportion to the beam current μA.

As described above, an electron beam for a color cathode-ray tube in accordance with the present invention includes two control electrode plates which are placed in individual accelerating/focusing electrodes such that they are recessed from rim surfaces of the envelops of the accelerating/focusing electrodes by predetermined distances in the axial direction, to thus effectively enlarge the aperture of the main focusing lens. The electric field of the main focusing lens in the horizontal and vertical directions is thus efficiently controlled.

In addition, the central electron beam and the side electron beams are preferably controlled by center openings and outer opposed openings of the control electrode plates, respectively. These openings have various profiles so that the electron beam converging effect toward the central electron beam is remarkably improved. In this regard, the electron gun of the present invention reduces the spherical aberration as well as the flying spot aberration, to thus improve the resolution of the color cathode-ray tube.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An electron gun for a color cathode-ray tube having axial, horizontal and vertical directions, said directions being substantially perpendicular to one another, comprising:

means for generating a plurality of electron beams, said beams representing color components for forming a color image, respectively; and a pair of electrode means being substantially symmetrical to one another with respect to said horizontal direction and coaxial with said tube in said axial direction, and providing a passage for said plurality of electron beams, said pair of electrode means being spaced apart from each other by a predetermined distance in said axial direction and having common openings for each beam, said common openings facing each other, each of said electrode means including:

an envelope having a rim adjacent a corresponding common opening, said rim surrounding said plurality of electron beams and defining said common opening; and a control electrode plate having an inclined portion at an inclination angle in said axial direction for strengthening the lens action in the horizontal direction, being placed in said envelope and recessed from said rim by a predetermined distance in said axial direction in order to control said plurality of electron beams, said inclined portion being formed along sides of a rectangular center opening, and along sides of outer openings, said outer openings being disposed at opposed sides of said center opening, and said outer openings each opening toward an inner surface of said envelope for defining side beam passages.

2. The electron gun according to claim 1, wherein the inclination angle is an acute angle, greater than zero, when considered relative to the axial direction.

3. An electron gun for a color cathode-ray tube having axial, horizontal and vertical directions, said directions being substantially perpendicular to one another, comprising:

means for generating a plurality of electron beams, said beams representing respective color components for forming a color image; and a pair of electrodes spaced axially, said pair of electrodes being substantially symmetrical in the axial direction about a horizontal line located midway between the electrodes, and each electrode being substantially symmetrical in said horizontal direction, said pair of electrodes providing passages for said plurality of electron beams, each of said electrodes further including an envelope having a rim adjacent a common opening, said rim surrounding said plurality of electron beams and defining said common opening; and a control electrode plate, located within an envelope, having upper and lower beam members connected by a pair of spaced apart column members so as to form a center opening having top and bottom sides and left and right sides, respectively, and so as to form two outer openings, one on each opposite side in the horizontal direction from said center opening, said column members each having a bend near an end thereof where attached to said upper and lower beam members such that a middle portion of the center opening formed by said column members is located at a first axial position which is different from axial positions of the top and bottom sides of the center opening.

4. The electron gun according to claim 3, wherein an open space between said upper and lower beam members for each of said two outer openings gradually increases in the vertical dimension with horizontal distance from the tube axis.

5. The electron gun according to claim 3, wherein the top and bottom and left and right sides of the center opening are discontiguous and form a rectangular center opening, the bend being such that the top and bottom sides of the rectangular opening are located at axial positions other than the first axial position.

6. The electron gun according to claim 5, wherein said control electrode plate is placed in said envelope such that a longer side of its rectangular center opening vertically crosses with the horizontal direction of said common opening.

7. The electron gun according to claim 3, wherein the top and bottom sides are arcuate and are discontiguous from the left and right sides.

8. The electron gun according to claim 7, wherein the left and right sides include straight portions parallel to one another and connecting the top and bottom walls.

9. The electron gun according to claim 3, wherein the bends are located near a top end of each column member, and further including another bend near the bottom end of each column member such that a portion of each column member extending between its respective bends is substantially planar and substantially vertical.

10. The electron gun according to claim 3, wherein each envelope contains one of said control electrode plates, said control electrode plates being arranged such that (1) the first axial position in a first one of said control electrode plates is more distant, when considered in the axial direction, than axial positions of the top and bottom sides of the first control electrode plate, and (2) the first axial position in a second one of said control electrode plates is less distant, when considered in the axial direction, than axial positions of the top and bottom sides of the second control electrode plate.

11. The electron gun according to claim 3, wherein the bend is at an acute angle, greater than zero, when considered relative to the axial direction.

* * * * *